US005389939A

United States Patent [19]

Tang et al.

[11] Patent Number: 5,389,939

[45] Date of Patent: Feb. 14, 1995

[54] ULTRA WIDEBAND PHASED ARRAY ANTENNA

[75] Inventors: Raymond Tang, Fullerton; Kuan M. Lee, Brea, both of Calif.

[73] Assignee: Hughes Aircraft Company, Los Angeles, Calif.

[21] Appl. No.: 40,788

[22] Filed: Mar. 31, 1993

[51] Int. Cl.[6] ..... H01Q 19/06

[52] U.S. Cl. ..... 343/754; 343/753; 343/793

[58] Field of Search ..... 343/853, 753, 754, 793, 343/795, 810, 814; 342/371, 372, 373, 374, 376

[56] References Cited

U.S. PATENT DOCUMENTS

| | | | |
|---|---|---|---|
| 3,568,184 | 3/1971 | Drabowitch | 343/754 |
| 3,631,503 | 12/1974 | Tang et al. | 343/754 |
| 4,010,471 | 3/1977 | Smith | 343/754 |
| 4,091387 | 1/1978 | Profera | 343/754 |
| 5,087,922 | 2/1992 | Tang et al. | 343/814 |

FOREIGN PATENT DOCUMENTS

| | | | |
|---|---|---|---|
| 0197803 | 6/1972 | Germany | 343/754 |
| 0035459 | 4/1978 | Japan | 343/754 |
| 0146562 | 11/1979 | Japan | 343/754 |
| 0161866 | 12/1979 | Japan | 343/754 |

OTHER PUBLICATIONS

"Waveguide Handbook," N. Marcuvitz, pp. 280–285, Dover Publication, 1951.

*Primary Examiner*—Donald Hajec
*Assistant Examiner*—Tan Ho
*Attorney, Agent, or Firm*—W. K. Denson-Low

[57] ABSTRACT

An ultra wideband (UWB) phased array antenna using a frequency-multiplexing, space-fed lens with a UWB feed horn achieves multi-octave bandwidth. The lens includes two UWB radiating apertures with relatively narrow band phase shifters connecting corresponding radiating elements of the arrays. Each aperture multiplexes the incoming UWB signal into separate frequency bands so that the phase shifters need only be tuned to these narrower frequency bands, and are set to form a beam in the desired direction. For wide instantaneous bandwidth operation, the beams from the various frequency bands are collimated in the same direction. For multi-mode operation, the beams corresponding to the various frequency bands are formed in different directions. The phase shifters need have a maximum phase shift of 360 degrees.

24 Claims, 5 Drawing Sheets

ULTRA WIDEBAND PHASED ARRAY ANTENNA

BACKGROUND OF THE INVENTION

The invention relates to wideband radars having an electronic beam scanning capability.

In order to achieve wide instantaneous bandwidth (signal bandwidth), conventional phased arrays use time delay phase shifters (time delay compensation) at each radiating element or subarray level. For a given beam scan angle each time delay phase shifter is adjusted so that the radiated signals from the elements all arrive at the same time to form a plane wavefront in the direction of the beam scan angle. Due to the long delay lines required for large arrays, the time delay phase shifters are bulky, lossy and costly.

An object of this invention is to provide an ultra wideband radar with an electronic beam scanning capability so that it can rapidly search over a large volume of space for potential energy threats.

SUMMARY OF THE INVENTION

In accordance with this invention, a frequency multiplexing, spaced-fed lens is used in conjunction with an ultra wideband ("UWB") feed horn to achieve multi-octave signal bandwidth (instantaneous bandwidth). The space-fed lens includes two UWB radiating apertures with relatively narrow band phase shifters connecting the corresponding radiating elements of the two apertures. Each UWB aperture multiplexes the incoming UWB signal into separate frequency bands so that the phase shifters need only to be tuned to these narrower frequency bands. The phase shifters in each frequency band are set to form a beam in the desired direction.

For wide instantaneous bandwidth operation, the beams from the various frequency bands are collimated in the same direction. For multi-mode radar operation, the beams corresponding to the various frequency bands are formed in different directions so that, for example, an X-Band beam is used for tracking a target or fire control, an L-Band beam is used for search, and so on. In a sense, this UWB antenna is composed of several overlapping multi-octave frequency antennas sharing a common antenna aperture, thus providing a multi-function radar capability with search, track, fire-control and communication functions. The phase shifters used in the UWB lens are the conventional phase shifters used in phased arrays, e.g., diode or ferrite phase shifters with a maximum phase shift of 360 degrees instead of the time delay phase shifters.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

The purpose of this invention is to provide an ultra wideband radar with an electronic beam scanning capability so that it can rapidly search over a large volume of space for any potential energy threats. As used herein, "ultra wideband" refers to a bandwidth covering several octaves. Some of the advantages of ultra wideband ("UWB") radar are: (1) to reduce the probability of intercept by anti-radiation missiles; (2) mitigate multipath fading and RF interference problems; and (3) perform target identification. The ultra wideband beam steering in this invention is accomplished using relatively narrow band phase shifters instead of time delay phase shifters which are bulky and costly. Furthermore, the use of a space feed in accordance with this invention to illuminate the ultra wideband phase scanning lens greatly simplifies the feeding network of the ultra wideband phased array.

Figure 1:
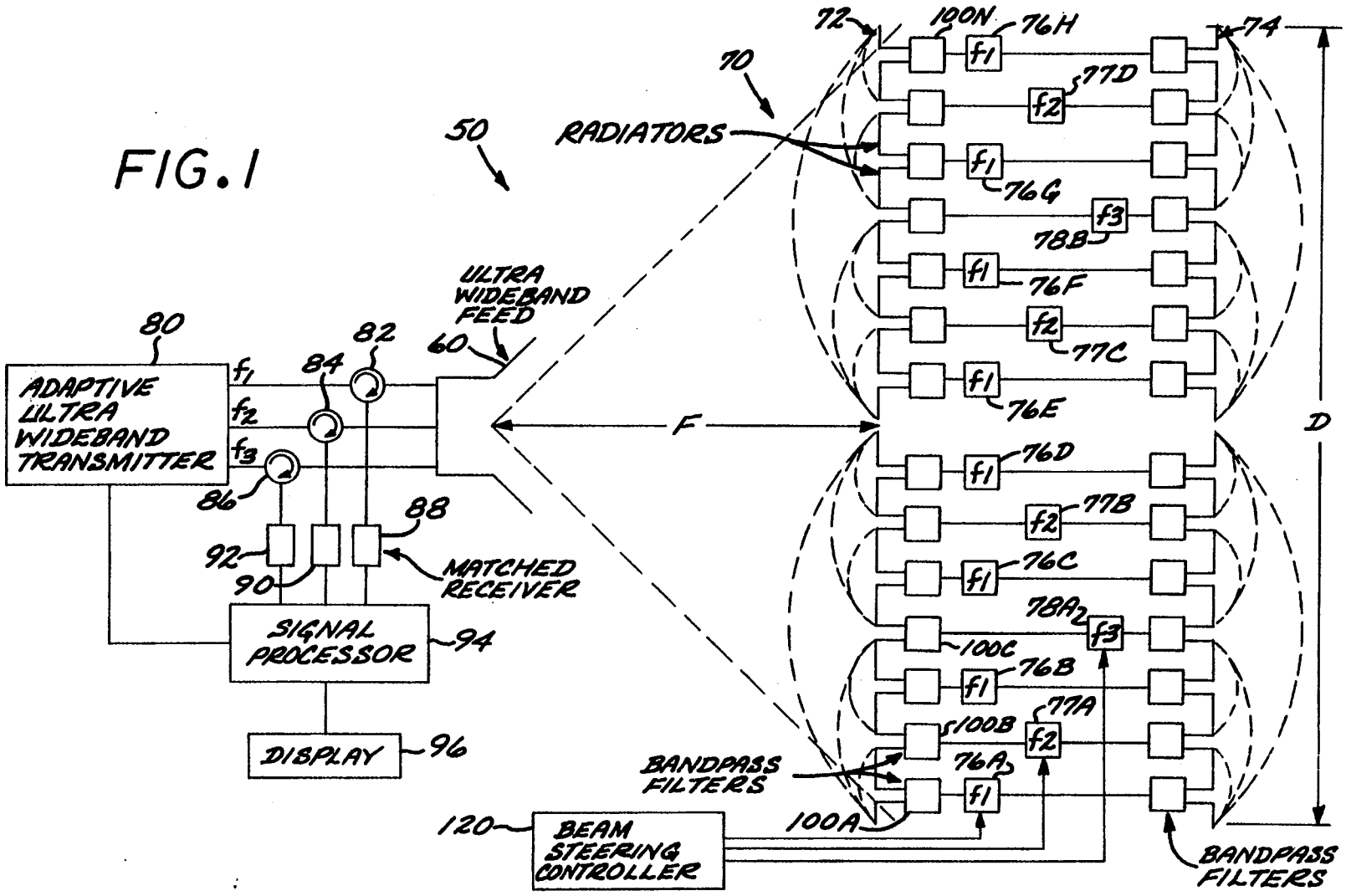
FIG. 1 is a simplified schematic of an ultra wideband phased array antenna system in accordance with the invention.

A simplified schematic of a space-fed, ultra wideband phased array antenna system 50 embodying the invention is illustrated in FIG. 1. This UWB phased array antenna comprises an UWB feed 60 and an UWB phase scanning lens 70. An adaptive UWB transmitter section 80 with three output ports at frequencies $f_1$, $f_2$ and $f_3$ is connected to the feed 60 through circulators 82, 84 and 86. The circulators separate the receive signals from the transmit signals, sending the received signals to respective matched receivers 88, 90 and 92 at the frequencies $f_1$, $f_2$ and $f_3$. The frequencies $f_1$, $f_2$, and $f_3$ are the respective center frequencies for three frequency bands of operation for the system, e.g.., 2–4 GHz, 4–8 GHz and 8–16 GHz. It will be appreciated that the system is not limited to three frequency bands of operation, as the system may be designed to accommodate fewer or greater bands of operation. Furthermore, there could be several operating frequencies in each band.

A signal processor 94 processes the receiver output signals and generates radar images on a display 96. The transmitter can be adjusted to send out various waveforms and frequencies based on the outputs from the receiver and signal processor.

The UWB feed 60 illuminates the two dimensional phase scanning lens through free space. This UWB feed 60 could be, for example, a nested cup dipole feed as shown in commonly assigned U.S. Pat. No. 4,042,935, the entire contents of which are incorporated herein by this reference. Alternatively, contiguous feed horns, one for each frequency band, may be used.

The focal distance of the feed 60 from the lens 70 is selected to provide the required amplitude illumination of the lens and to minimize spillover loss. Typically an f/D ratio of 0.5 is chosen, where f is the focal distance and D is the diameter of the two dimensional lens 70. This space feed approach eliminates the need of a complex ultra wideband feed network to distribute the signals to the radiating elements.

The two dimensional phase scanning lens 70 includes an UWB pickup array 72 facing the UWB feed 60, an UWB radiating array 74, and relatively narrow band phase shifters 76, 77 and 78 in between corresponding pairs of the radiating elements of arrays 72 and 74. A beam steering controller 120 is coupled to respective control ports of each shift setting to form beams for the respective frequency bands. The lens 70 is "two-dimensional" in the sense that the lens can perform a two-dimensional phase scanning function.

Figure 4:
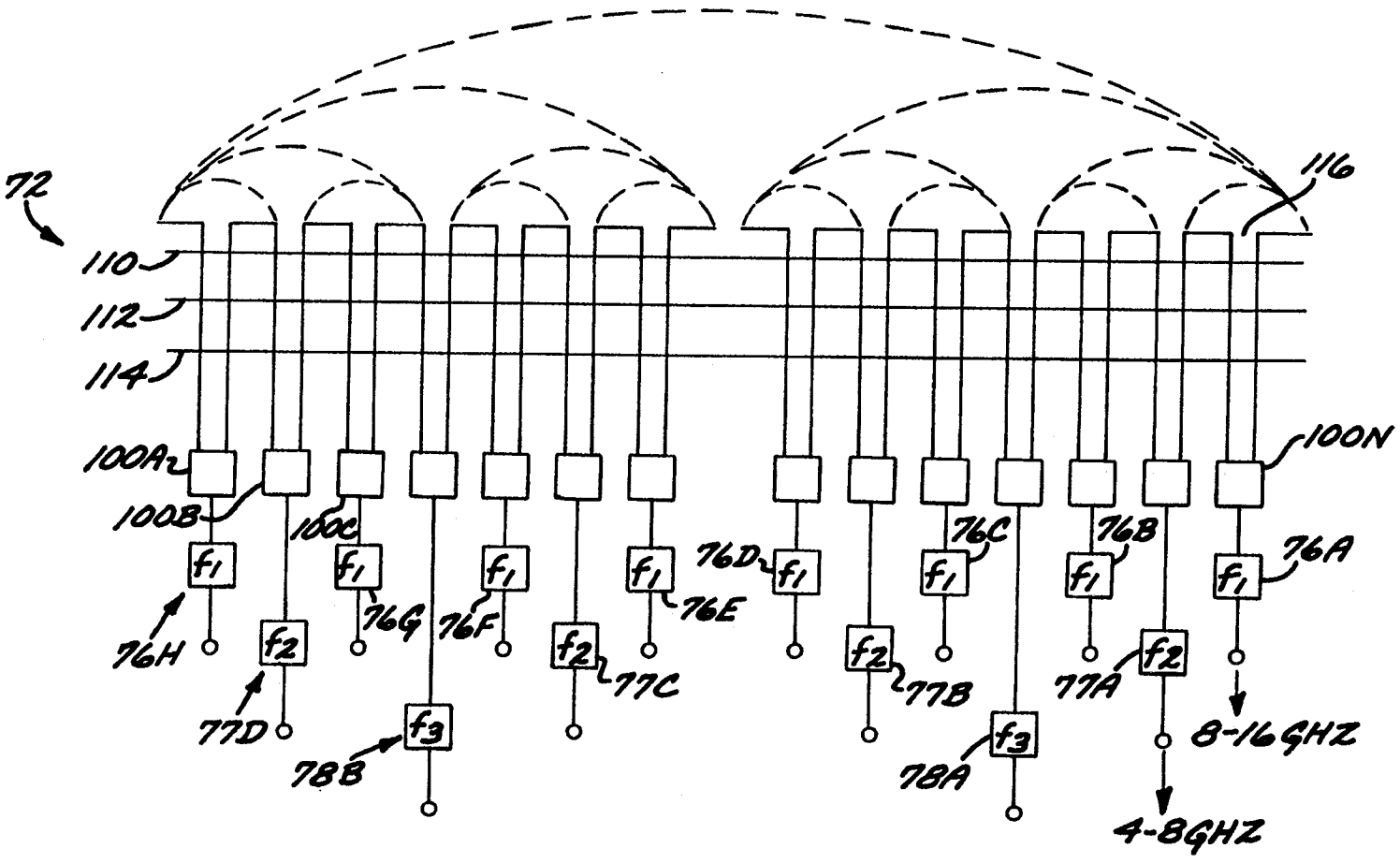
FIG. 4 is a simplified schematic illustrating the aperture design of the arrays comprising the phase scanning lens of the antenna system of FIG. 1.

The aperture design of the two UWB arrays 72 and 74 utilizes multiplexing co-planar dipoles with multiple feed ports. A detailed description of this co-planar dipole with multiple feed ports is set forth in commonly assigned U.S. Pat. No. 5,087,922, the entire contents of which are incorporated herein by this reference. Array 72 is shown in FIG. 4 in greater detail and includes multiple feed ports 116. Array 74 is the mirror image of array 72.

In each array 72 and 74, all active dipoles are contiguous, and lie in the same respective aperture plane. An array of dipoles of different effective resonant length is achieved for each operating frequency band. The electrical spacing between these resonant length dipoles varies with frequency to maintain half-wavelength separation of dipoles for all operating frequency bands. This is done to avoid grating lobe formation over the required radar surveillance volume. In order to accomplish this, dipole elements are connected to multiple excitation ports 116 with bandpass filters 100A–100N as shown in FIG. 4, which illustrates a cross-sectional slice of the array 72. The bandpass filters 100 are used to achieve open circuits or short circuits for the particular frequency bands. In so doing, all the radiating elements for the various operating frequency bands share a common physical aperture.

To provide the required dipole height, as a function of frequency, several frequency selective ground planes 110, 112, 114 are used for different operating frequency bands. In this exemplary embodiment, ground screen 110 provides the ground plane for an 8–16 GHz frequency band, screen 112 provides the ground plane for a 4–8 GHz band, and screen 114 provides the ground plane for a 2–4 Ghz band. High frequency ground screens are arranged to be closer to the active radiating elements than the lower frequency ground planes and result in good reflection at the resonant frequency. For lower frequency operation, the combined effect of the high frequency screen and the additional low frequency screen will yield the desired ground reflection for the lower operating frequency. The design of ground screens is well known in the art. For example, see "Waveguide Handbook," N. Marenvitz, pages 280–285, Dover Publication, 1951.

Figure 2:
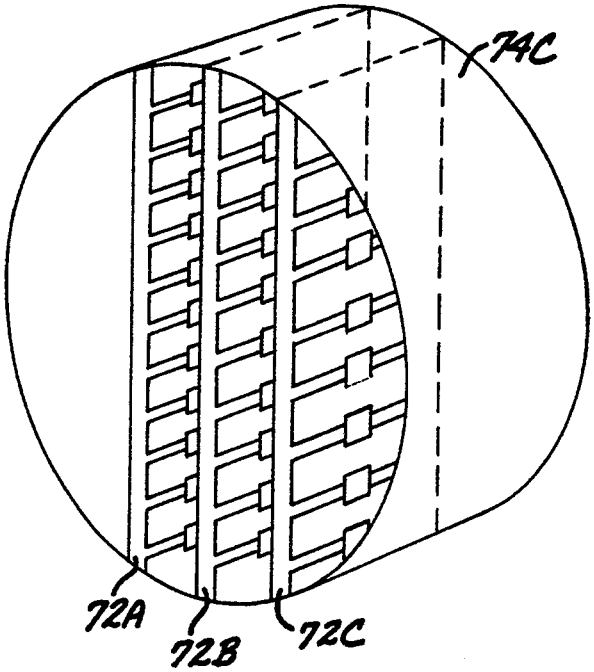
FIG. 2 is a simplified isometric view of the space fed lens of the system of FIG. 1.
Figure 3:
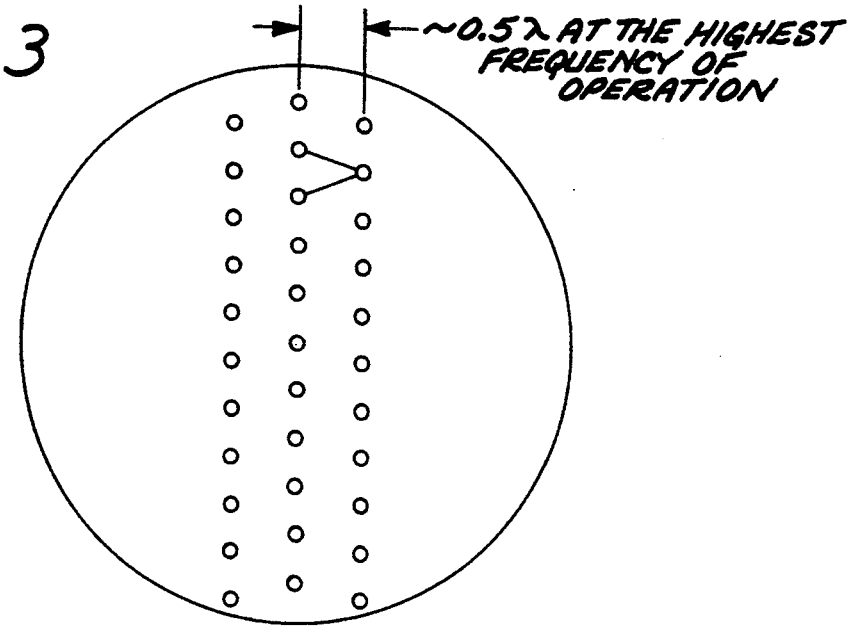
FIG. 3 is a simplified end view of the lines of FIG. 2.

FIG. 2 is an isometric view of the space-fed lens 70, and illustrates the assembly of a plurality of the two-dimensional lens units comprising arrays 72 and 74 of FIG. 1. Thus, in FIG. 2, illustrative units shown as arrays 72A and 74A, 72B and 74B and 72C and 74C are arranged in a spaced, parallel relationship. The array units are separated by 0.5 wavelength at the highest frequency of operation. Moreover, the dipole radiator elements of each array unit are offset from the dipoles in adjacent array units, so that the centers of two adjacent dipoles on one unit form an isosceles triangle with the center of a dipole on an adjacent unit, as shown in FIG. 3.

The operation of the phased array 50 is now described. On transmit, the signals from the high power transmitters comprising the transmitter section 80 are input to the UWB feed 60 through the high power circulators 82, 84 and 86. The high power circulators serve the duplexing function of separating the various frequency transmit signals from those of the received signals from the antenna. The various frequency transmit signals from the transmitter section 80 are radiated from the UWB feed 60 to illuminate the two dimensional phase scanning lens 70. The UWB feed 60 shapes the illumination pattern so that the required amplitude taper is applied across the lens 70 to achieve the desired sidelobe level. Also, the amplitude taper of the illumination pattern is designed to minimize spillover loss.

Figure 5:
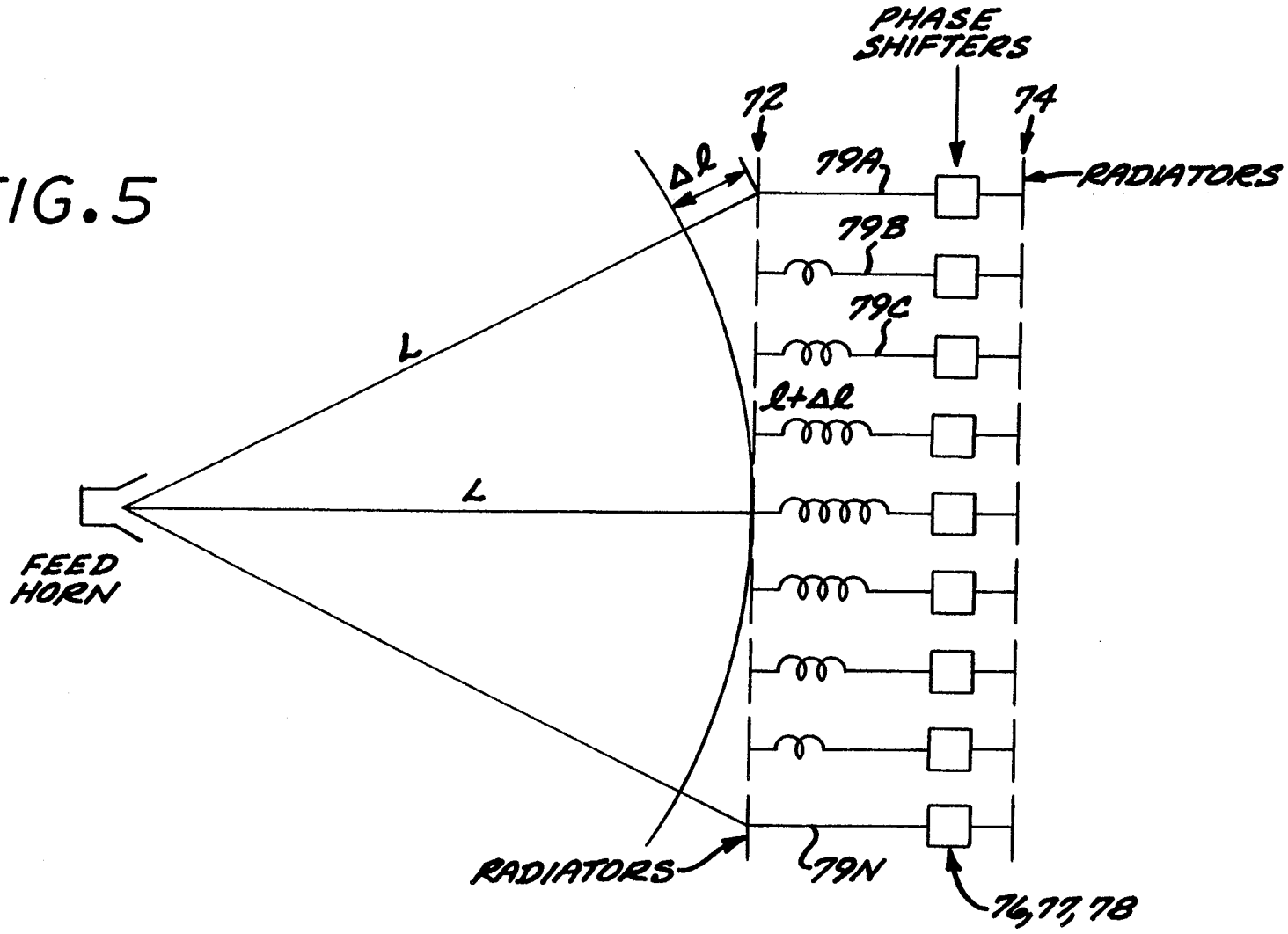
FIG. 5 is a simplified schematic diagram illustrating the use of line length compensation of the spherical wavefront.

Phase coherence of the various frequency signals is preserved by having a common phase center for all the different frequency radiators in the feed 60, in the case of a nested cup dipole feed. The various frequency signals illuminating the pickup array 72 of the lens 70 are picked up by the UWB coplanar dipoles. These coplanar dipoles multiplex the incoming ultra wideband signals so that signals at the different frequency bands are isolated and appear at separate output ports of the dipoles. These isolated signals, corresponding to the various frequency bands, are transmitted through the appropriate phase shifters 76, 77, 78 which are tuned to the corresponding frequency bands. Fixed lengths of coaxial cables 79A–79N are incorporated proceeding each phase shifter 76, 77, 78 to correct the spherical phase front from the feed 60 as shown in FIG. 5, so that the signals input into the phase shifters are in-phase. These phase shifted signals are re-radiated into space through a similar set of coplanar dipoles in the radiating array 74.

Figure 6:
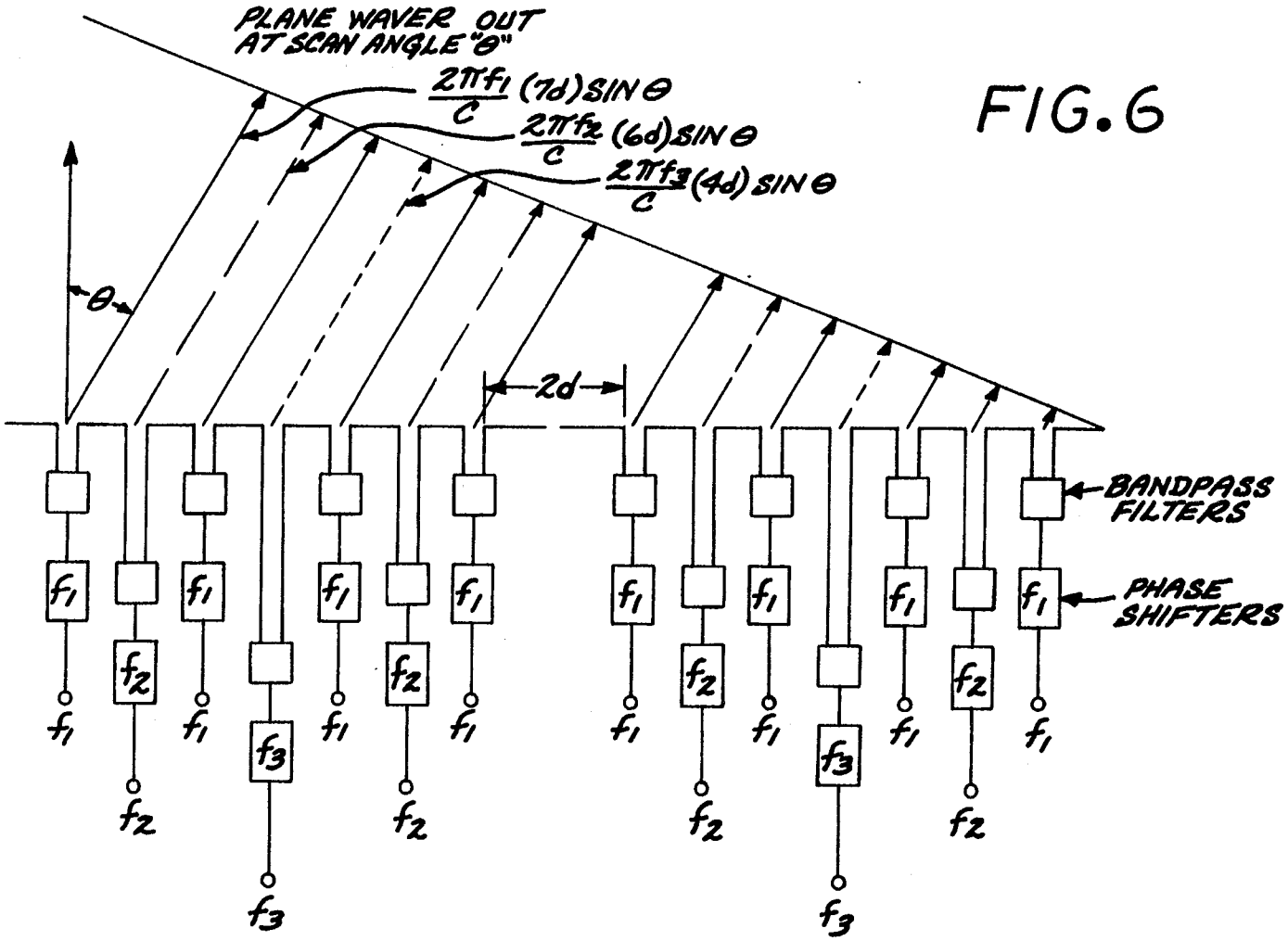
FIG. 6 illustrates the use of phase shifters to form a beam of wide instantaneous bandwidth.

For wide instantaneous bandwidth operation, the phase shifters 76, 77, 78 corresponding to the various frequency bands are set to provide the appropriate phase shifts at each band so that the re-radiated signals at the various frequencies are collimated in the same direction to form a beam of wide instantaneous bandwidth. FIG. 6 illustrates this setting of the phase shifters to accomplish this function. For multi-mode operation, the re-radiated signals at the various frequency bands are collimated in different directions to form multiple simultaneous beams of different frequencies at different angles.

In the radar receive mode, a wide bandwidth threat signal from a target in a given direction in space is picked up by the UWB coplanar dipole elements in the radiating array of the lens. The threat signal is multiplexed and its spectral components are phase shifted and re-radiated from the corresponding coplanar dipole in the pickup array of the lens. The phase shifters are set to focus all the spectral components of the threat signal to the same focal point of the UWB feed. The multiplexers in the UWB feed isolates these spectral signals and input into various multiple receive channels for processing as shown in FIG. 4.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A phased array antenna system for illuminating a given radar surveillance volume, said system covering a plurality of separate frequency bands, comprising:

a space-fed frequency multiplexing lens comprising first and second radiating apertures, said first aperture facing a space feed means, said second aperture for illuminating said volume, each aperture comprising a plurality of radiating elements each in turn coupled to a corresponding radiating element of the other radiating aperture through a phase shifter device, each said aperture comprising means for multiplexing an incoming wideband signal into separate frequency band signals, said multiplexing means comprising a first plurality of arrays of radiating elements comprising said plurality of radiating elements of said first radiating aperture, each array operating at a particular one of said separate frequency bands, and a corresponding second plurality of arrays of radiating elements comprising said plurality of radiating elements of said second radiating aperture, and wherein the radiating elements of said first plurality of arrays share a common physical first aperture, and the radiating elements of said second plurality of arrays share a common physical second aperture, and wherein said phase shifter devices are each associated with signals of one of said frequency bands and are only required to perform a phase shifting function over the particular frequency band with which said phase shifter is associated; and said space feed means for illuminating said first aperture with signals covering said plurality of separate frequency bands, said feed means comprising a plurality of radiators each for radiating signals of a particular one of said separate frequency bands, and wherein said radiators share a common phase center.

2. The system of claim 1 wherein said first array is characterized by a diameter D, and wherein said feed means comprises a feed radiator located a focal distance f from said first array, where $f/D=0.5$.

3. The system of claim 1 wherein said phase shifter devices are variable phase shifter devices having the capability for providing a selected phase shift at a particular frequency in the range between 0 degrees and 360 degrees, and said system further comprises beam steering controller means for controlling said phase shifter devices to steer beams formed by radiating elements comprising said second aperture.

4. The system of claim 3 wherein said controller means includes means for setting the phase shift of the phase shifters associated with a first one of said frequency bands to form a first beam in said first one of said frequency bands to a first desired direction, and means for setting the phase shift of the phase shifters associated with a second one of said frequency bands to form a second beam in said second one of said frequency bands to a desired second direction to provide multi-mode radar operation.

5. The system of claim 3 wherein said controller means further comprises means for setting the phase shift of all said phase shift devices to collimate said beams to the same direction to provide wide instantaneous bandwidth operation over each of said plurality of separate frequency bands.

6. The system of claim 1 wherein said space feed means comprises a feed horn assembly located at a focal point of said first array.

7. The system of claim 1 wherein said radiating elements of said first and second apertures comprises dipoles of different effective resonant length for each operating frequency band, said dipole radiating elements for each aperture disposed in a respective common array plane.

8. The system of claim 7 wherein the electrical spacing between said dipoles varies with frequency to maintain half-wavelength separation of dipoles for each operating band to reduce grating lobe formation over said surveillance volume.

9. The system of claim 1 wherein said space feed means provides a spherical wavefront which illuminates said first radiating aperture, and wherein said lens further comprises a plurality of transmission lines connected between corresponding pairs of radiating elements of said first and second radiating apertures, and the respective lengths of said transmission lines are selected to provide compensation for said spherical wavefront.

10. The system of claim 9 wherein said plurality of transmission lines comprises a plurality of coaxial cables connecting respective ones of said radiating elements of said first array to corresponding phase shifters, and wherein the lengths of said coaxial cable transmission lines are selected such that signals input into said phase shifters from said cables are in-phase.

11. The system of claim 1 wherein said space feed comprises a nested cup dipole feed comprising a dipole feed structure for each said frequency band.

12. The system of claim 1 wherein said plurality of separate frequency bands cover a multi-octave bandwidth.

13. A phased array antenna system for illuminating a given radar surveillance volume, said system covering a plurality of separate frequency bands, comprising:

a space-fed frequency multiplexing lens comprising first and second radiating apertures, said first aperture facing a space feed means, said second aperture for illuminating said volume, each aperture comprising a plurality of radiating elements each in turn coupled to a corresponding radiating element of the other radiating aperture through a phase shifter device, each said aperture comprising means for multiplexing an incoming wideband signal into separate frequency band signals., said multiplexing means comprising a first plurality of arrays of radiating elements comprising said plurality of radiating elements of said first radiating aperture, each array operating at a particular one of said separate frequency bands, and a corresponding second plurality of arrays of radiating elements comprising said plurality of radiating elements of said second radiating aperture, and wherein the radiating elements of said first plurality of arrays share a common physical first aperture, and the radiating elements of said second plurality of arrays share a common physical second aperture, and wherein said phase shifter devices are each associated with signals of one of said frequency bands and is only required to perform a phase shifting function over the particular frequency band with which said phase shifter is associated;

said space feed means for illuminating said first aperture with signals covering said plurality of separate frequency bands, said feed means comprising a plurality of radiators each for radiating signals of a particular one of said separate frequency bands, and wherein said radiators share a common phase center;

wideband transmitter means for generating transmitter wideband signals covering said frequency bands;

receiver means responsive to signals received by said lens to provide radar receiver signals;

signals duplexing means coupling said transmitter means and said receiver means to said space feed means, said duplexing means separating said transmitter signals and said received signals.

14. The system of claim 13 wherein said first array is characterized by a diameter D, and wherein said feed means comprises a feed radiator located a focal distance f from said first array, where f/D=0.5.

15. The system of claim 13 wherein said phase shifter devices are variable phase shifter devices having the capability for providing a selected phase shift at a particular frequency in the range between 0 degrees and 360 degrees, and said system further comprises beam steering controller means for controlling said phase shifter devices to steer beams formed by radiating elements comprising said second aperture.

16. The system of claim 15 wherein said controller means includes means for setting the phase shift of the phase shifters associated with a first one of said frequency bands to form a first beam in said first one of said frequency bands to a first desired direction, and means for setting the phase shift of the phase shifters associated with a second one of said frequency bands to form a second beam in said second one of said frequency bands to a desired second direction to provide multi-mode radar operation.

17. The system of claim 15 wherein said controller means further comprises means for setting the phase shift of all said phase shift devices to collimate said beams to the same direction to provide wide instantaneous band width operation over said plurality of separate frequency bands.

18. The system of claim 13 wherein said space feed means comprises a feed horn assembly located at a focal point of said first radiating aperture.

19. The system of claim 13 wherein said radiating elements of said first and second radiating apertures comprises dipoles of different effective resonant length for each operating frequency band, said dipole radiating elements for each radiating aperture disposed in a respective common array plane.

20. The system of claim 19 wherein the electrical spacing between said dipoles varies with frequency to maintain half-wavelength separation of dipoles for each operating band to reduce grating lobe formation over said surveillance volume.

21. The system of claim 13 wherein said space feed means provides a spherical wavefront which illuminates said first array, and wherein said lens further comprises a plurality of transmission lines connected between corresponding pairs of radiating elements of said first and second radiating apertures, and the respective lengths of said transmission lines are selected to provide compensation for said spherical wavefront.

22. The system of claim 21 wherein said plurality of transmission lines comprises a plurality of coaxial cables connecting respective ones of said radiating elements of said first array to corresponding phase shifters, and wherein the lengths of said cables are selected such that signals input into said phase shifters from said cables are in-phase.

23. The-system of claim 13 wherein said space feed comprises a nested cup dipole feed comprising a dipole feed structure for each said frequency band.

24. The system of claim 13 wherein said plurality of separate frequency bands cover a multi-octave bandwidth.

* * * * *